US006993927B2

(12) United States Patent
Austen et al.

(10) Patent No.: US 6,993,927 B2
(45) Date of Patent: Feb. 7, 2006

(54) THERMAL INSULATION FOR ELECTRONIC DEVICES

(75) Inventors: Paul M. Austen, Milwaukie, OR (US); Rex L. Breunsbach, Clackamas, OR (US)

(73) Assignee: Electronic Controls Design, Inc., Milwaukie, OR (US)

( * ) Notice: Subject to any disclaimer, the term of this patent is extended or adjusted under 35 U.S.C. 154(b) by 0 days.

(21) Appl. No.: 10/759,805

(22) Filed: Jan. 15, 2004

(65) Prior Publication Data

US 2005/0155371 A1 Jul. 21, 2005

(51) Int. Cl.
*F25D 23/12* (2006.01)

(52) U.S. Cl. ..... 62/259.2; 361/689

(58) Field of Classification Search ..... 62/259.2, 62/3.2, 3.3, 3.6; 165/104.23; 361/689
See application file for complete search history.

(56) References Cited

U.S. PATENT DOCUMENTS

| | | | | |
|---|---|---|---|---|
| 2,808,338 | A | 10/1957 | Bruno et al. | |
| 2,811,457 | A | 10/1957 | Speil et al. | |
| 3,055,831 | A | 9/1962 | Barnett et al. | |
| 4,600,634 | A | 7/1986 | Langer | |
| 4,921,894 | A | 5/1990 | Shumate | |
| 5,059,378 | A | 10/1991 | Petterson et al. | |
| 5,770,295 | A | 6/1998 | Alderman | |
| 5,804,294 | A | 9/1998 | Gregg et al. | |
| 5,910,267 | A | 6/1999 | Stricker | |
| 6,045,718 | A | 4/2000 | Holman et al. | |
| 6,074,711 | A * | 6/2000 | Ghazarian | 429/30 |
| 6,086,609 | A * | 7/2000 | Buckley | 607/104 |
| 6,402,372 | B1 | 6/2002 | Saunders | |
| 6,464,672 | B1 | 10/2002 | Buckley | |
| 6,498,114 | B1 * | 12/2002 | Amundson et al. | 438/780 |
| 6,673,436 | B2 * | 1/2004 | Kawaguchi et al. | 428/330 |

OTHER PUBLICATIONS

"Albany International: High Performance Materials: Pyropel® Rigid Insulation for Plastics and Rubber Processing," 3 pages, http://www.albint.com/WEB/hpm/pyropel.nsf/c44f1192aa7b71dcc12565bf004a2886/dfd697674866ca48852565df0070157e!OpenDocument, website visited Nov. 2003.

"DuPont® Kapton® polyimide film: Adhesion to Kapton®," Technical Bulletin, 4 pages, http://www.dupont.com/kapton/general/adhesion.pdf, website visited Nov. 2003.

"CCT Custom Cutting Technologies, Inc.: Duratron Polyimide," 2 pages, http://cctplastics.com/duratron.html, website visited Dec. 2003.

"KIC On-line Store—Steel Shield 1/8" Med Temp Upgrade Kit, 9CH Dual (Part #7-TS-SL-18-LF-KIT), 1 page, http://secure.kicthermal.com/cgi-bin/KICstore/KICstore.pl, website visited Nov. 2003.

"KIC On-line Store—Thermal Shield 'Water Jacket', Max 150C (Part #7-TS-WB)," 1 page, http://secure.kicthermal.com/cgi-bin/KICstore/KICstore.pl, website visited Nov. 2003.

* cited by examiner

*Primary Examiner*—Melvin Jones
(74) *Attorney, Agent, or Firm*—Klarquist Sparkman, LLP

(57) ABSTRACT

Methods and devices for insulating electronic devices are disclosed. The devices include a jacket comprising an absorbing material wetted with a liquid cooling-agent. When the jacket is introduced into a heated process-environment, the liquid cooling-agent evaporates and cools the jacket. The absorbing material can comprise a heat-resistant, organic, polymeric material, such as a network of polyimide fibers.

25 Claims, 4 Drawing Sheets

THERMAL INSULATION FOR ELECTRONIC DEVICES

FIELD

This disclosure concerns devices and methods for thermally insulating electronic devices.

BACKGROUND

Many manufacturing processes involve high-temperature process steps. One example is the solder-reflow process used in the manufacture of circuit boards. In the solder-reflow process, circuit boards are passed through an oven on a conveyor. Within the oven, the circuit boards are subjected to multiple zones at varying temperatures. With the advent of no-lead solder, the temperatures used in solder-reflow processes have increased. Too much heat, however, can damage the circuit boards. The ovens must heat the circuit boards enough to fuse the solder, but not enough to damage to the circuit boards.

Solder-reflow processes are just some of the many high-temperature processes that require careful monitoring. Temperature is usually the key environmental parameter, but some processes also are sensitive to other parameters, such as relative humidity. Environmental parameters such as temperature and relative humidity can be monitored with electronic devices, which typically have at least one sensor and associated circuitry, including one or more components such as a processor, a memory, a DC power source, etc. These electronic devices are typically passed into the process environments and experience the same conditions as the product being processed, which may occur over several minutes. The recorded data can be monitored real-time or reviewed after the process is completed. In this way, the profile of the process can be studied and optimized. For example, the temperature profile of a solder-reflow process can be maintained within the optimal processing window.

Certain components of electronic devices, e.g. batteries, are damaged or degraded when exposed to high temperatures. Thus, some conventional approaches to data-gathering use insulation around the devices in an effort to shield the devices from the full effects of the high-temperature environments. For example, U.S. Pat. No. 6,402,372 discloses a flight-data recorder surrounded by a housing comprising a high-temperature, insulating, structural material, such as a fiber-reinforced epoxy. Such an approach is typically not feasible for production-oriented monitoring devices, however, at least because of size considerations, cost considerations, and the need to have ready access to the devices.

As typical process temperatures increase, the conventional approaches to insulating electronic devices prove to be inadequate. A need exists for providing increased thermal protection to electronic devices that is relatively inexpensive, durable, and able to work within the physical and environmental constraints of conventional ovens.

SUMMARY

Surprisingly, it has been discovered that providing a liquid cooling-agent and a jacket or covering that is capable of absorbing the liquid cooling-agent allows for the improved insulation of electronic devices. Typically, electronic devices are not exposed to liquids, since such exposure can lead to short circuits and/or other damage, but this can be avoided, e.g., by providing a sealed device, separating the device within an impermeable layer, and/or carefully controlling the wetting of the jacket material. Insulation systems incorporating a liquid cooling-agent and an absorbing material can be made cost effective, durable, easy to handle, and/or sufficiently small to pass through conventional ovens, which provides advantages over conventional approaches.

This disclosure describes an insulating jacket for an electronic device and methods of using such a jacket. At least a portion of the jacket is capable of absorbing a liquid cooling-agent. When the wetted jacket is introduced into a heated process-environment, the liquid cooling-agent evaporates, cooling the jacket. The wetted jacket serves as a thermal barrier between the electronic device and the environment. As the liquid cooling-agent evaporates, the jacket still provides at least some insulation, e.g., by the effect of air filling interstitial spaces in the jacket, if present.

The jacket material can comprise a heat-resistant, organic, polymeric material, such as a network of polyimide fibers. The liquid cooling-agent is preferably held in the interstitial spaces formed around the jacket material and does not penetrate the jacket material itself.

In some embodiments, the jacket includes a non-absorbent liner to prevent the liquid cooling-agent from entering the interior of the electronic device. Some embodiments also include a first temperature-sensor positioned outside the jacket and a second temperature-sensor embedded within the jacket. These sensors enable the measurement of wet-bulb and dry-bulb temperatures and thereby enable the calculation of relative humidity.

DETAILED DESCRIPTION

Figure 1:
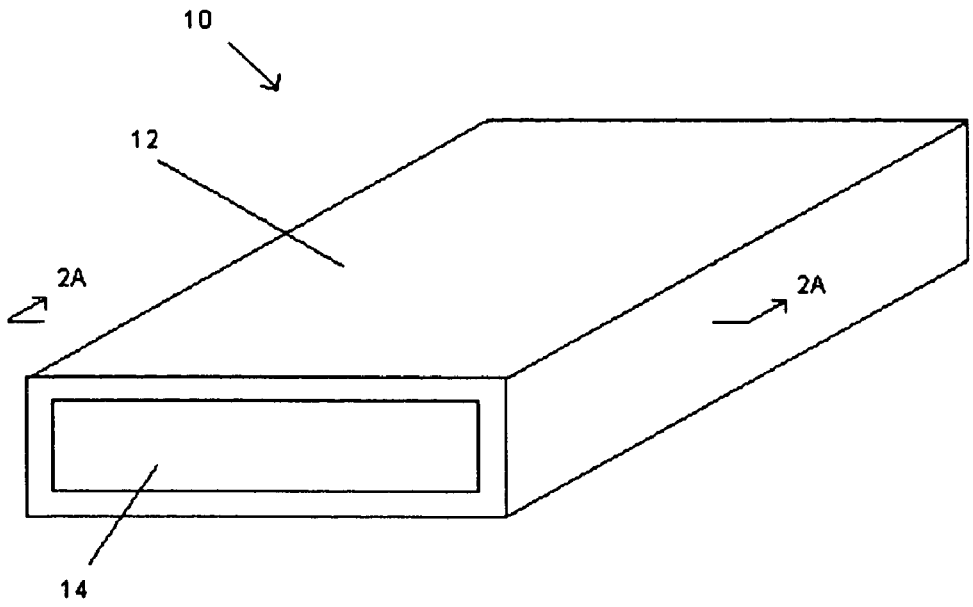
FIG. 1 is a perspective view of one embodiment of an insulating jacket.
Figure 2A:
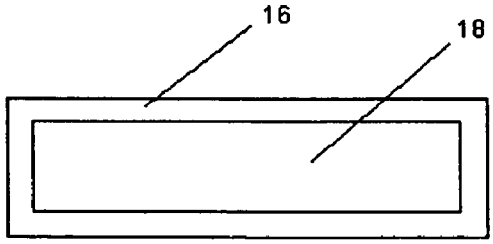
FIG. 2A is a cross-sectional view of a first embodiment of the jacket illustrated in FIG. 1, taken at 2A—2A.
Figure 2B:
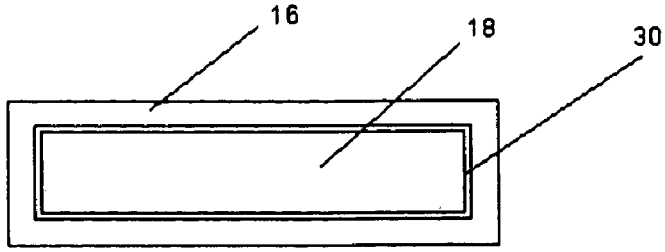
FIG. 2B is a cross-sectional view similar to FIG. 2A, except showing a second embodiment of the jacket with an internal liner.
Figure 3:
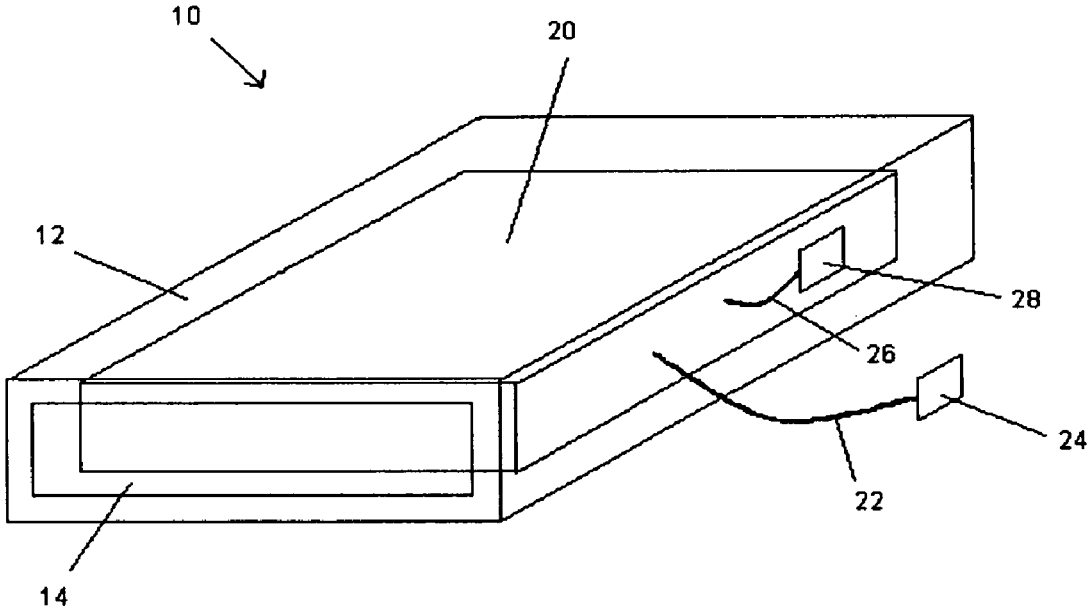
FIG. 3 is a perspective view of the jacket illustrated in FIG. 1 showing an electronic device received within the jacket and thermocouples connected to the device.

In a specific embodiment shown in FIGS. 1–3, a jacket 10 has a generally rectangular solid shape with an outer surface 12. As best shown in FIG. 3, there is an internal cavity 18 dimensioned to receive an object, e.g., an electronic device 20, defined within jacket 10. Jacket 10 can be fitted with one or more access portions, e.g. a removable portion 14, to allow access to internal cavity 18. In use, at least a portion of jacket 10 is wetted with a liquid cooling-agent (not shown) before jacket 10 and electronic device 20 are introduced into a heated environment.

FIG. 2A is a cross-sectional view of one embodiment of jacket 10 taken at 2A—2A. As shown, this embodiment of jacket 10 comprises absorbing material 16 in a configuration substantially surrounding internal cavity 18. If a multilayer construction is used, one or more of the layers may be formed of the absorbing material.

As shown in FIG. 3, the illustrated implementation of electronic device 20 has a first thermocouple-lead 22 connected to a dry thermocouple-sensor 24. First thermocouple-lead 22 extends from electronic device 20 through jacket 10 to the external environment. Electronic device 20 can also have a second thermocouple-lead 26 connected to a wet thermocouple-sensor 28. Wet thermocouple-sensor 28 is positioned within a wetted portion of the jacket material.

Jacket 10 is useful for protecting electronic device 20 from high-temperature environments, such as environments over 120° C. Electronic device 20 is inserted into jacket 10 by removing removable portion 14 and then sliding electronic device 20 into internal cavity 18. Removable portion 14 is then replaced. The thermocouples, if present, are connected as shown, which may include extending one or more thermocouple leads from their connections at the device into jacket 10 and/or through openings in jacket 10. Shortly before introducing jacket 10 and electronic device 20 into a heated environment, at least a portion of jacket 10 is wetted with the liquid cooling-agent. The liquid cooling-agent and/or the jacket can optionally be cooled before application, such as in a refrigerator. The wetting process can be accomplished, for example, by spraying the liquid cooling-agent onto jacket 10 from a hand-held dispenser or, alternatively, by immersing jacket 10 in a reservoir containing the liquid cooling-agent.

After being introduced into a heated environment, the temperature of the liquid cooling-agent will begin to increase. As the temperature of the liquid cooling-agent increases, the evaporation rate of the liquid cooling-agent will also increase. The evaporation of the liquid cooling-agent consumes its characteristic latent heat of evaporation and therefore has a net cooling effect on absorbing material 16. In this way, the temperature of absorbing material 16 can be maintained for a prolonged period at a temperature well below the temperature of the environment.

If jacket 10 remains in the heated environment, eventually all of the liquid cooling-agent will evaporate. Air will fill the spaces formerly occupied by the liquid cooling-agent. In its dry state, absorbing material 16 continues to act as a thermal insulator. Therefore, the temperature of internal cavity 18 and electronic device 20 will remain below the temperature of the environment for an extended period.

One consideration in designing an insulation system for electronic devices is size. The environments to be monitored sometimes have limited available space. For example, in solder-reflow ovens, the height of the process environment can be just a few centimeters. The width of the oven opening may also be only minimally larger than the device. Thus, for such applications, it is advantageous if the jacket fits closely around the device. The rectangular shape of jacket 10, illustrated in FIG. 1, is well suited for insulating electronic devices designed to be used in processes in which height is restricted.

Other embodiments of the jacket can be shaped differently than the embodiment illustrated in FIG. 1. The jacket can be shaped to fit around electronic devices of varying sizes and shapes. In bread-baking operations, height is typically not restricted. Electronic devices designed for monitoring bread-baking operations can be relatively tall. A thermal-insulation jacket can easily be modified to accommodate these diverse shapes and sizes.

The effectiveness of thermal-insulation jackets is partially dependent on the materials selected for these jackets. In order to maintain structural integrity at elevated temperatures, at least the outer portion of the jacket should comprise a heat-resistant material. Heat-resistant materials are those materials capable of maintaining their structural integrity in common high-temperature process-environments. Typically, such materials have melting points (for crystalline solids) or glass-transition temperatures (for polymers) greater than 120° C., more typically greater than 200° C., and even more typically greater than 250° C.

Some materials are heat-resistant when wet, but not heat-resistant when dry. These materials are not ideal jacket materials because the liquid cooling-agent can evaporate rapidly. Even if the jacket is usually wetted before being introduced into a heated process-environment, it would be undesirable to incorporate a material that melts on the occasions when it is not wetted or when all of the liquid cooling-agent evaporates. Thus, it is advantageous if the jacket material is capable of maintaining its structural integrity in high-temperature environments without the aid of a liquid cooling-agent under expected conditions.

A variety of materials are capable of maintaining their structural integrity in high-temperature environments. The material, however, also should be able to absorb liquids and act as an insulator even when dry. Furthermore, the material should be durable enough to withstand being repeatedly wetted and dried. Closed cell silicon-foams are not effective at absorbing liquids. Metals are not effective insulators when dry. Certain ceramic materials are not durable when wet.

Insulation materials comprising a network of organic polymer fibers are particularly well-suited for incorporation into thermal-insulation jackets. Organic polymers have relatively low thermal conductivity. Organic polymers are also lightweight and easy to mold into different forms. Organic polymer fibers can be made to be particularly thin. Networks of organic polymer fibers are capable of absorbing and holding large amounts of liquid. The liquid is held on the surfaces of the fibers. Since the liquid does not readily absorb into the fibers themselves, the structural integrity of the material is not adversely affected when the material is wetted.

Few organic polymers are capable of withstanding high temperatures, such as temperatures greater than 120° C. Among these heat-resistant polymers are several types of polyimides. Polyimides are polymers in which the monomers are the diacyl derivatives of ammonia or primary amines. Polyimides are characterized by particularly strong interactions between the polymer chains. The temperature at which polymer chains begin to disassociate is called the glass-transition temperature. Many polyimides have glass-transition temperatures greater than 250° C.

Like most organic polymers, polyimides are combustible if heated to high enough temperatures. Polyimides, however, will tend to char rather than burn. Therefore, jackets comprising polyimides are unlikely to cause a fire, even if used at excessively high temperatures.

Organic polymers are versatile and can be made into a variety of forms. Any form that is capable of absorbing and retaining liquid is suitable for incorporation into thermal-insulation jackets. One particularly advantageous form comprises a network of fibers. When dry, the interstitial spaces between the fibers are occupied by air. This makes the material an effective insulator when dry. These same interstitial spaces can also be occupied by a liquid. The large surface area of the fibers helps hold the liquid in place.

Material comprising a network of polyimide fibers can be purchased in sheets called fiberboard. Fiberboard is available in different densities that reflect how tightly the fibers are packed together. For some embodiments of thermal-insulation jackets, the polyimide fiberboard typically has a density of 50 kg/m$^3$ to 500 kg/m$^3$, more typically 100 kg/m$^3$ to 300 kg/m$^3$, and even more typically 170 kg/m$^3$ to 220 kg/m$^3$.

The insulation properties of the jacket are partially dependant on the thickness of the jacket. Thickness, however, is sometimes limited by the available space in the environments to be monitored. In the embodiment illustrated in FIGS. 1–3, the absorbing material 16 comprises polyimide fiberboard with a thickness of 0.95 cm (⅜ inch). Material with a thickness of 0.64 cm (¼ inch) may also be used. Either thickness is suitable for embodiments to be used in process environments in which space is limited. Of course, a wide range of material thicknesses can be incorporated into the jacket.

Suitable polyimide fiber materials include PYROPEL® fiberboard product sold by Albany International (Albany, N.Y.) and products made with KAPTON® polyimide material sold by Dupont (Wilmington, Del.). PYROPEL® grade MD-12 is particularly well suited for incorporation into thermal-insulation jackets.

U.S. Pat. No. 5,059,378, which is incorporated herein by this reference, describes PYROPEL® as comprising synthetic fibers exhibiting high temperature resistance, high strength and/or high modulus of elasticity. Suitable fiber materials include polyimides, polyamides, polyesters, acrylics, polypropylene (and higher polyolefins), polyphenylene sulfide, polyestherimide, aromatic esther ketones, and the like.

As indicated, in some jacket implementations, the electronic device needs to be shielded from the liquid cooling-agent. To do this, a non-absorbing liner can be incorporated into the jacket. FIG. 2B is a cross-sectional view of a jacket embodiment that includes a liner 30. Liner 30 is positioned on the inside of absorbing material 16. This ensures that the bulk of the wetted insulation material is separated from the electronic device.

Like the electronic device, the liner is insulated by the jacket's absorbing material. It is therefore possible to use a material with a high thermal conductivity, such as metal, without substantially impairing the overall insulating effect of the jacket. However, it is somewhat preferable to make the liner out of a material with a low thermal conductivity. Thereby, the liner will add to the overall insulation effect of the jacket.

In order to protect the electronic device from moisture, the liner should be substantially non-absorbent. Metal sheets are generally non-absorbent. Many types of organic polymers, including polyimides, can be made into non-absorbent forms. Organic polymers are well-suited for incorporation into the liner for many of the same reasons described above with regard to their incorporation into the absorbing material. Among these reasons are their versatility and their low thermal conductivity. Because the liner is partially shielded, the liner material does not need to be as heat resistant as the absorbing material. For example, polymers with glass-transition temperatures above 200° C. might be suitable in some embodiments.

The liquid cooling-agent can be any liquid that is relatively stable at room temperature and will evaporate in a heated environment. Water is a good choice because it is readily available, it has a high heat capacity, and it evaporates readily in the temperature range of many common processes. Some processes, however, may be sensitive to water. In such circumstances, another liquid cooling-agent can be used. Alcohols and organic solvents are among the alternative liquid cooling-agents. Many process environments, such as solder-reflow process ovens, are specially vented. This venting limits environmental concerns. In some embodiments, the liquid cooling-agent is cooled before it is applied to the jacket. Alternatively, the entire jacket can be cooled. These techniques increase the ability of the jacket to thermally insulate the electronic device.

To make the embodiment illustrated in FIGS. 1–3, polyimide fiberboard of the desired thickness is cut into pieces for the top, bottom, sides and ends of the jacket. These pieces are connected by any suitable methods, e.g. using adhesive, staples, pins, or the like. The removable portion 14 may be formed separately or cut out from one end. The electronic device is placed in the jacket with any thermocouple lead(s) extending out through dedicated holes or through the opening enclosed by removable portion 14. Alternative embodiments of the jacket can be fixed to the exterior of the electronic device. In such embodiments, the jacket is normally not removed from the electronic device.

In most heated process-environments, an important parameter that needs to be monitored is temperature. As illustrated in FIG. 3, electronic device 20 can be configured to record temperature with dry thermocouple-sensor 24. The signal is then passed into electronic device 20 through first thermocouple-lead 22. Electronic devices often have multiple thermocouple sensors capable of monitoring the temperature at a variety of points. In other implementations, the electronic device can be configured to sense or process other parameters.

If desired, jacket 10 can be configured to provide a close estimation of relative humidity as well as temperature. This is a useful parameter for several processes, such as the processes used in the baked goods industry. Calculating relative humidity requires the measurement of a wet-bulb temperature and a dry-bulb temperature. The wet-bulb temperature is the temperature of a wet surface in the same area. The dry-bulb temperature is the temperature of a dry surface. With these two temperatures, relative humidity can be calculated with a simple equation. Some embodiments of thermal-insulation jackets enable this calculation because the wet-bulb temperature can be measured by placing a sensor inside the wet absorbing material.

In FIG. 3, the wet-bulb temperature is measured by wet thermocouple-sensor 28. Wet thermocouple-sensor 28 is embedded very near to exterior surface of absorbing material 16. This prevents the insulating properties of absorbing material 16 from substantially affecting the measurement.

Figure 4:
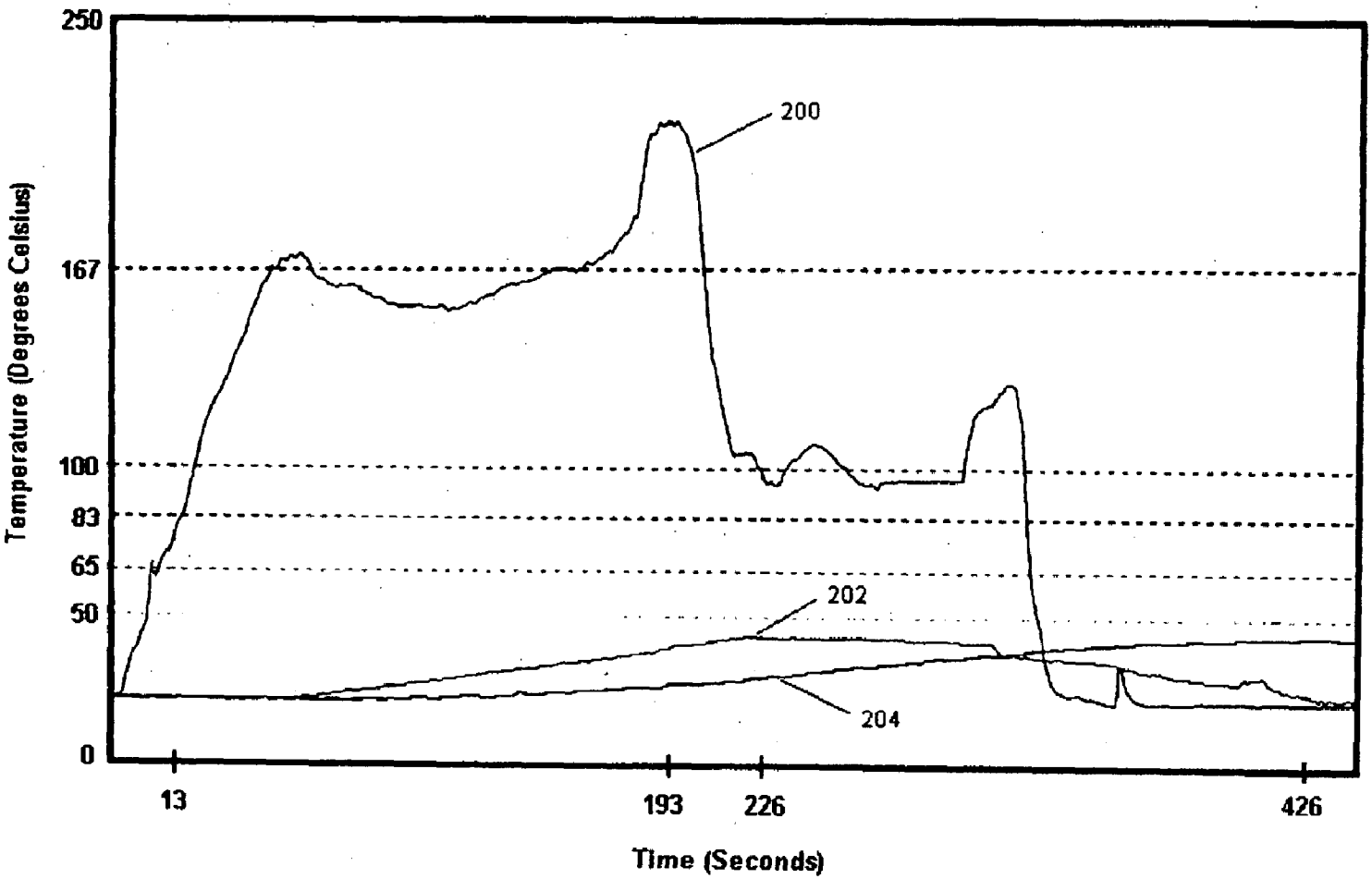
FIG. 4 is a graph showing the temperature of the environment, the temperature of the inside of the jacket, and the temperature of the surface of the electronic device plotted against time for a typical no-lead solder-reflow process, where the jacket is initially wetted in a predetermined manner with a liquid cooling-agent.
Figure 5:
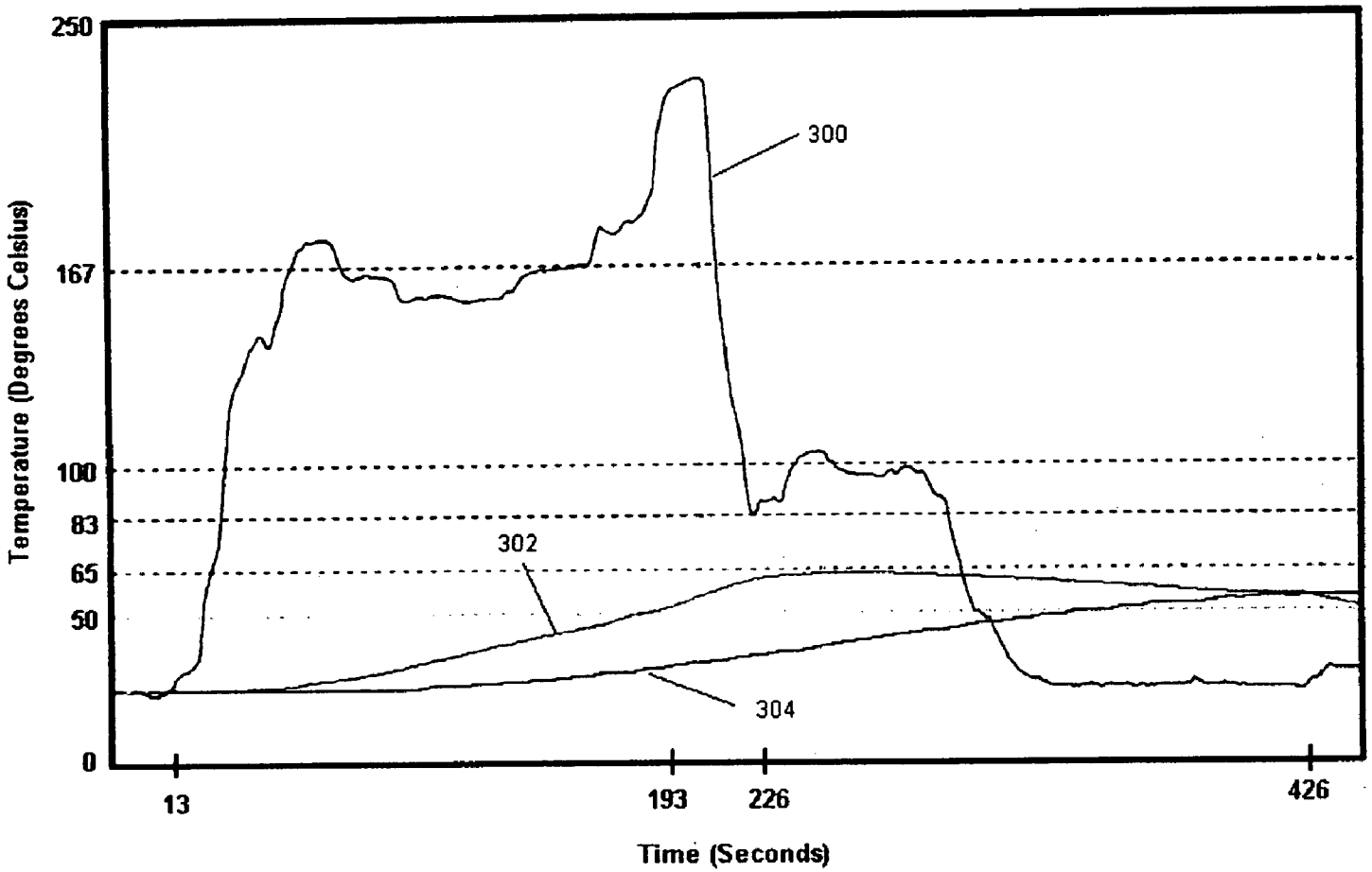
FIG. 5 is a graph showing the temperature of the environment, the temperature of the inside of the jacket, and the temperature of the surface of the electronic device plotted against time for a typical no-lead solder-reflow process, where the jacket is dry.

FIGS. 4 and 5 illustrate how the liquid cooling-agent improves the thermal insulation of an electronic device in one exemplary implementation. The graphs were produced by sending an insulated electronic device into an oven calibrated with typical solder-reflow process parameters. The oven was an OMNIFLO® 7, manufactured by Speedline Technologies of Franklin, Mass. The electronic device was a M.O.L.E.® manufactured by Electronic Controls Design, Inc., of Milwaukie, Oreg. The electronic device was insulated with a jacket similar to the jacket illustrated in FIG. 1. The absorbing material was 0.95 cm of PYROPEL®.

To generate FIG. 4, the absorbing material was wetted with water before being introduced into the process environment. To generate FIG. 5, the absorbing material was kept dry. In FIG. 4, a first profile 200 indicates the temperature of the environment, a second profile 202 indicates the temperature of the absorbing material, and a third profile 204 indicates the temperature on the surface of the electronic device. In FIG. 5, a first profile 300 indicates the temperature of the environment, a second profile 302 indicates the temperature of the absorbing material, and a third profile 304 indicates the temperature on the surface of the electronic device.

First profiles 200 and 300 are roughly the same, since the same oven settings were used for each trial. Second profile 202, when compared to second profile 302, demonstrates that the temperature of the absorbing material is maintained at a lower level when the absorbing material is wet. Third profile 204, when compared to third profile 304, demonstrates that the temperature of the electronic device is also maintained at a lower level when the absorbing material is wet. Thus, the use of a liquid cooling-agent improves the thermal insulation of the electronic device.

Having illustrated and described several different embodiments of the invention, it should be apparent to those skilled in the art that the invention may be modified in arrangement and detail. We claim as our invention all such modifications as come within the true spirit and scope of the following claims.

We claim:

1. An insulating jacket for an electronic device, the jacket comprising:

an absorbing material comprising a heat-resistant, organic, polymeric material defining a space shaped to receive the device; and a liquid cooling-agent;

wherein the liquid cooling-agent is absorbed within at least a portion of the absorbing material.

2. The jacket of claim 1, wherein the polymeric material comprises a polyimide.

3. The jacket of claim 1, wherein the polymeric material has a glass-transition temperature greater than 250° C.

4. The jacket of claim 1, wherein the absorbing material comprises a network of fibers.

5. The jacket of claim 1, wherein the liquid cooling-agent does not substantially penetrate the polymeric material.

6. The jacket of claim 1, wherein the liquid cooling-agent is chilled to below room temperature.

7. The jacket of claim 1, wherein the density of the absorbing material is between about 50 $kg/m^3$ and about 500 $kg/m^3$.

8. The jacket of claim 1, wherein the liquid cooling-agent is water.

9. An insulating jacket for an electronic device, the jacket comprising:

an absorbing material comprising a heat-resistant, organic, polymeric material defining a space shaped to receive the device;

a liquid cooling-agent; and an electronic device positioned within the jacket;

wherein the jacket is shaped to fit closely around the electronic device and the liquid cooling-agent is absorbed within at least a portion of the absorbing material.

10. An insulating jacket for an electronic device, the jacket comprising:

an absorbing material comprising a heat-resistant, organic, polymeric material defining a space shaped to receive the device;

a liquid cooling-agent; and an electronic device positioned within the jacket;

wherein the liquid cooling-agent is absorbed within at least a portion of the absorbing material, and wherein the electronic device has two or more temperature sensors, at least one of the temperatures sensors is positioned within the absorbing material, and at least one of the temperature sensors is positioned external to the jacket.

11. An insulating jacket for an electronic device, the jacket comprising:

an absorbing material comprising a heat-resistant, organic, polymeric material defining a space shaped to receive the device; and a liquid cooling-agent;

wherein the liquid cooling-agent is absorbed within at least a portion of the absorbing material and an interior of the jacket is lined with a substantially non-absorbing liner.

12. The jacket of claim 11, wherein the liner comprises a material with a glass-transition temperature greater than 200° C.

13. The jacket of claim 11, wherein the liner comprises a material selected from the group consisting of non-absorbing, organic, polymeric materials and metals.

14. The jacket of claim 11, wherein the liner comprises stainless steel.

15. An insulating jacket for an electronic device, the jacket comprising:

an absorbing material comprising a network of heat-resistant, organic, polymeric fibers;

a water-resistant liner; and a liquid cooling-agent absorbed within at least a portion of the absorbing material;

wherein the liner is positioned on the inside of the jacket and the absorbing material is capable of absorbing liquid.

16. An insulating jacket for an electronic device, the jacket comprising:

an absorbing material comprising a network of heat-resistant, organic, polymeric fibers; and a water-resistant liner;

wherein the liner is positioned on the inside of the jacket, the absorbing material is capable of absorbing liquid, and the absorbing material consists essentially of materials with glass-transition temperatures above 250° C.

17. An insulating jacket for an electronic device, the jacket comprising:

an absorbing material comprising a network of heat-resistant, organic, polymeric fibers; and a water-resistant liner;

wherein the liner is positioned on the inside of the jacket, the absorbing material is capable of absorbing liquid, and the liner comprises a material selected from the group consisting of non-absorbing, organic, polymeric materials and metals.

18. A method for measuring temperature comprising:

providing an electronic device substantially surrounded by an absorbing material, the absorbing material comprising a heat-resistant, organic, polymeric material;

wetting at least a portion of the absorbing material with a liquid cooling-agent; and introducing the electronic device substantially surrounded by the wetted absorbing material into an environment to be monitored.

19. The method of claim 18, wherein the liquid cooling-agent is chilled to below room temperature.

20. The method of claim 18, wherein the absorbing material comprises a network of polyimide fibers.

21. The method of claim 18, wherein the jacket further comprises a substantially non-absorbing liner positioned on the inside of the jacket.

22. The method of claim 18, wherein the liquid cooling-agent is applied to the jacket from a hand-held container.

23. The method of claim 18, wherein the environment to be monitored is at a temperature greater than 120° C.

24. A method for finding relative humidity comprising:

providing an electronic device substantially surrounded by an absorbing material;

wetting at least a portion of the absorbing material with a liquid cooling-agent;

introducing the electronic device substantially surrounded by the wetted absorbing material into an environment to be monitored;

measuring the temperature within the absorbing material;

measuring the temperature of the environment; and calculating relative humidity.

25. The jacket of claim 1, wherein the absorbing material forms an inner surface of at least a portion of the jacket, and wherein the inner surface of the jacket is adapted to be closely spaced from the electronic device.

* * * * *

UNITED STATES PATENT AND TRADEMARK OFFICE

CERTIFICATE OF CORRECTION

PATENT NO. : 6,993,927 B2
APPLICATION NO. : 10/759805
DATED : February 7, 2006
INVENTOR(S) : Austen et al.

It is certified that error appears in the above-identified patent and that said Letters Patent is hereby corrected as shown below:

On the Cover Page:

Under References Cited, U.S. Patent Documents, "Ghazarian" should read -- Cubukcu et al. --

Signed and Sealed this

Sixth Day of March, 2007

JON W. DUDAS
*Director of the United States Patent and Trademark Office*